United States Patent [19]

Carpenter, Jr. et al.

[11] 3,958,764

[45] May 25, 1976

[54] GRANULATING APPARATUS

[75] Inventors: James H. Carpenter, Jr.; Bernard W. Ixer, both of Hagerstown, Md.

[73] Assignee: The Carborundum Company, Niagara Falls, N.Y.

[22] Filed: Sept. 12, 1974

[21] Appl. No.: 505,289

Related U.S. Application Data

[62] Division of Ser. No. 254,279, May 17, 1972, Pat. No. 3,848,815.

[52] U.S. Cl. ..... 241/74; 241/DIG. 10

[51] Int. Cl.[2] ..... B02C 17/02

[58] Field of Search ..... 241/73, 74, 83, 85, 241/172, 174, 176, 178, 179, 180, 183; 209/284, 293, 296

[56] References Cited

UNITED STATES PATENTS 541,143 6/1895 Althin ..... 209/284

*Primary Examiner*—Granville Y. Custer, Jr.
*Attorney, Agent, or Firm*—David E. Dougherty; William H. Holt

[57] ABSTRACT

A substantially horizontally disposed drum is supported for rotation. One end of the drum is adapted to receive lumps of material which are granulated within the drum by abrasive particles which are projected from an abrasive throwing wheel. The drum includes a plurality of apertures through which the granulated material and abrasive particles are removed and subsequently conveyed to a separator for separating the granulated material from the abrasive particles. The apparatus may include a conditioner which scours the granulated material.

1 Claim, 12 Drawing Figures

33
29
51
37
51
38
25
31
35
51
33
38
27
29
25
37
39
41
29
27
53
55
77
19
11
13
15
43

57
99
63
85
83
95
97
101
93
91
89
75
73
77
65
69
67
87
79
81
77
103

167
121
136
127
129
135
57
122
71
131
124
133
137
71
57
169
125
155
171
157
159
165
126

GRANULATING APPARATUS

This is a division, of copending application Ser. No. 254,279, filed May 17, 1972, now U.S. Pat. No. 3,848,815 issued Nov. 19, 1974.

BACKGROUND OF THE INVENTION

The present invention relates to an apparatus for granulating lumps of material, especially lumps of molded sand.

Reconditioning of used sand from a shake-out operation involves reducing used core elements and molded sand lumps to individual sand grains and removing the metallic particles, sintered clusters of sand grains, excess fines and other tramp and objectionable material. The quality of reclaimed sand must be comparable to that of new sand so that it may be satisfactorily substituted for new sand in sand mixtures without appreciable change in sand practice.

Foundries are adopting a practice utilizing quality sand, a chemical binder, and a catalyst which are mixed together and hardened into a solid cake at ambient temperatures to form a chemically bonded mold. Since baking is not required, this process is known in the art as "no-bake" molding. The no-bake molding process has distinct advantages such as ease of making a mold, cleaner environment, ease of handling a completed mold, and improved casting finishes and casting tolerances.

Despite the numerous advantages, there are a number of disadvantages, such as the increased cost for quality grade sand. Therefore, the effective and efficient reclamation of sand can play a significant part in making the no-bake molding process economically attractive. One of the steps in the reclamation of sand used in no-bake molding is the reduction of lumps of molded no-bake sand.

Prior art apparatus typically used for granulating lumpy material include hammermills, ring crushers, jaw or roll crushers which generally subject moving parts to excessive wear and stresses thereby decreasing machine life and increasing machine breakdowns. The large quantity of dust created by prior art apparatus is not only an undesirable pollutant but is evidence that the lumps are crushed to such an extent that a good yield of granulated material such as reclaimed sand is sacrificed.

SUMMARY OF THE INVENTION

In an apparatus for granulating lumps, a drum having a plurality of apertures for the passage of granulated material and abrasive particles is supported for rotation about a substantially horizontal axis. The drum includes a spiral screw connected to the inner surface. Rotation of the drum causes the lumps to move toward a stream of abrasive particles projected with sufficient force to granulate the lumps. A separator removes the granulated material from the spent abrasive particles.

The present invention obviates one or more deficiencies of prior art devices and efficiently and effectively reclaims sand from lumps of molded sand.

DETAILED DESCRIPTION

Figure 2:
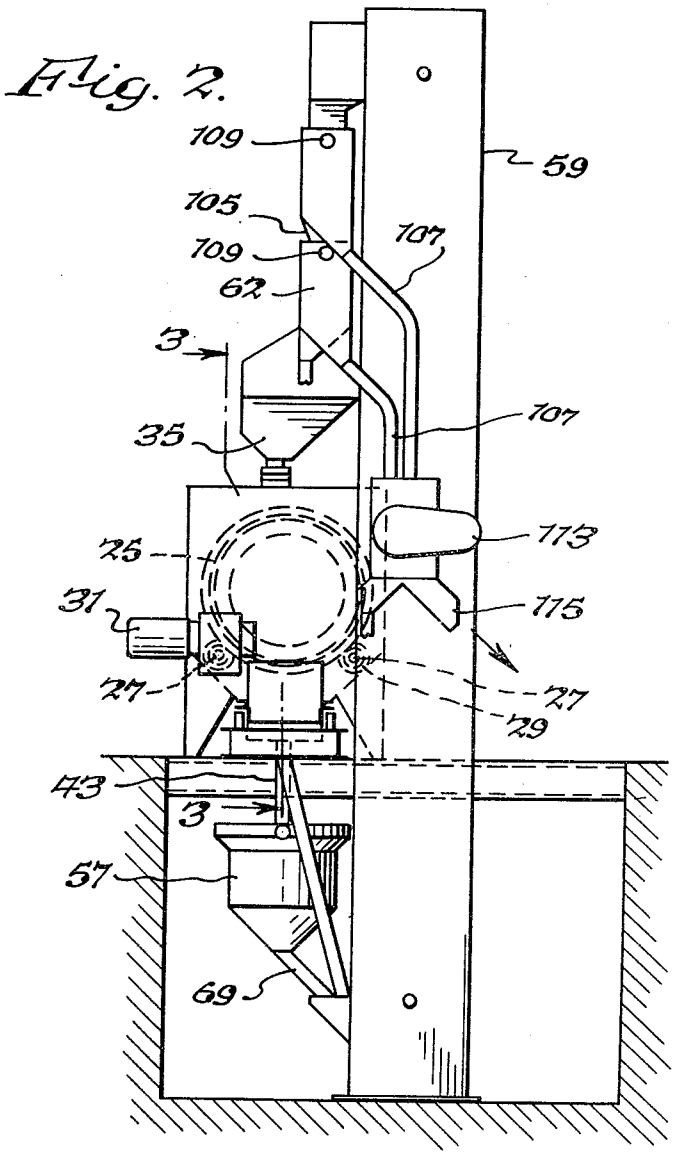
FIG. 2 is an end elevational view of the embodiment shown in FIG. 1.

Although the detailed description of the present invention is directed to the reclamation of sand from lumps of molded sand, it should be realized that the apparatus and process of this invention can be conveniently used to pulverize or reduce the size of lumps of various materials other than sand lumps, such as coal, phosphate rock, lime, rock salt, cement clinker, coke and various other materials.

Referring to the drawings in more detail, a feed mixture 11 which includes lumps of molded sand, and may include core rods, hangers, tramp iron of various sizes, sweepings and spillage, is fed through the feed tube 13 to an oscillating conveyor 15.

One method of forming the feed mixture comprises projecting abrasive particles against a mold with the casting therein to remove the sand and rods from the casting and cleaning the exposed casting in one operation. This is accomplished in a blast chamber with the sand, rods, spent abrasive, fines and other contaminants falling through the bottom of the chamber from where it is conveyed into the feed tube 13 and onto an oscillating conveyor 15.

The oscillating conveyor 15 includes a screen 17 of appropriate mesh size to permit the fines and small particles to fall into a hopper 19 and thence to an oscillating conveyor 21. The molded sand lumps, core rods, and any other elements in the mixture 11 which have a size larger than the apertures in the screen 17 are fed by the oscillating conveyor 15 into one end of a barrel or drum 25 which is mounted for rotation about a substantially horizontal axis.

The drum 25 is mounted for rotation between a pair of shafts 27 which are generally parallel to the axis of rotation of the drum 25. The shafts 27 have a plurality of rollers 29 mounted thereon in driving engagement with the drum 25. The shafts 27 are driven by a suitable motor 31. During rotation of the drum 25, abrasive particles are supplied to an abrasive blast means 33 from a feed hopper 35. The abrasive particles are projected into the lumps of molded sand within the drum 25 thereby granulating the sand into fine particles.

Figures 3, 4:
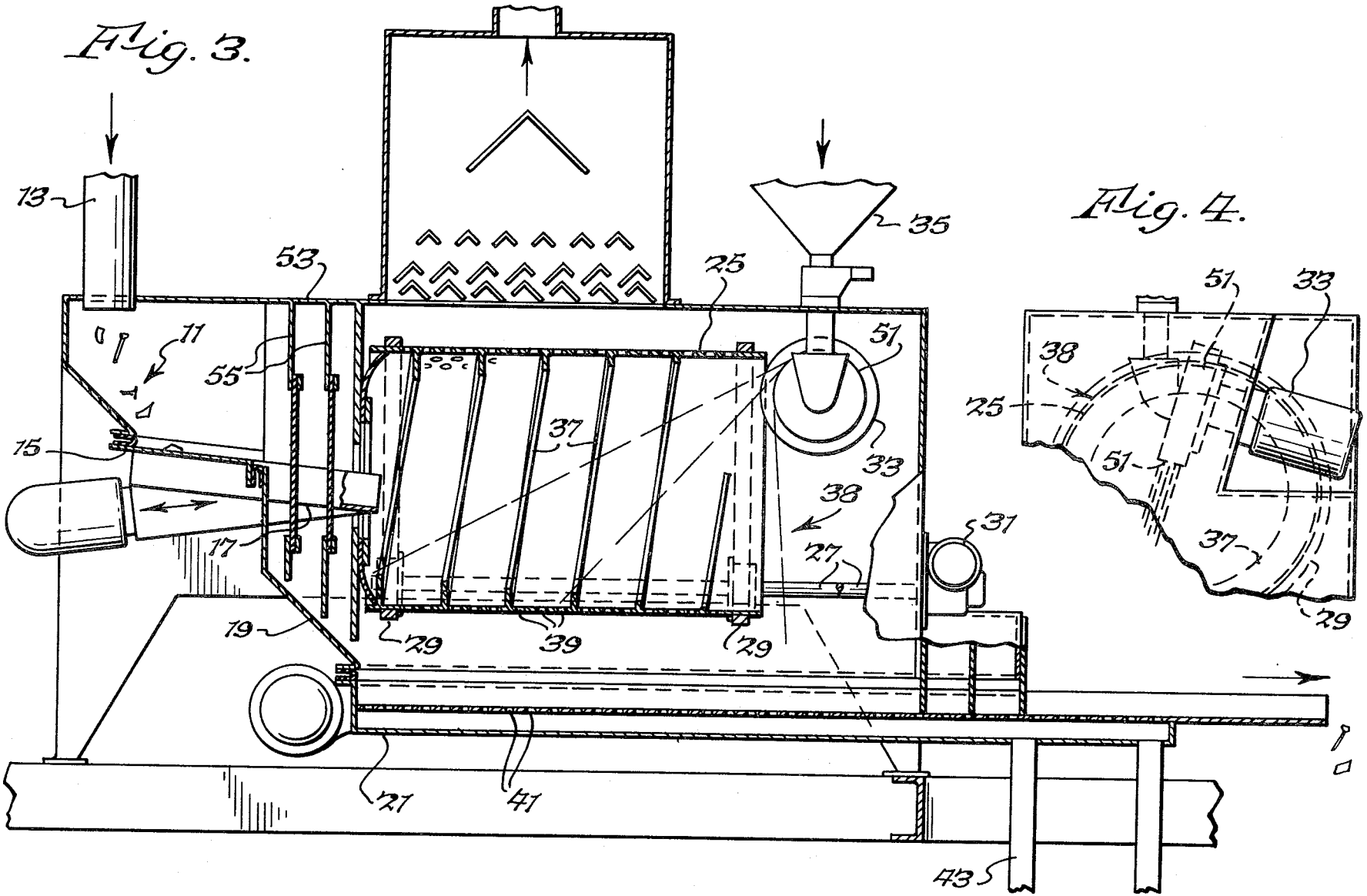
FIG. 3 is a cross-sectional view through FIG. 2 along the line 3—3.
FIG. 4 is an end view of the apparatus of FIG. 3.

The interior surface of the drum 25 is provided with a spiral screw 37 which drives the feed mixture 11 from an inlet end toward an outlet end 38. As illustrated in FIG. 3, the screw 37 comprises a plurality of sections or flights which extend over the entire interior surface of the drum 25. A flight is a portion of the spiral screw 37. The flights adjacent the inlet end project into the drum a greater distance than those near the outlet end 38. Preferably the projection of the flights tapers uniformly from a maximum of about 6 inches at the inlet end of the drum 25 to a minimum projection of about ½ ½inch at the exit or outlet end 38 of the drum 25. As abrasive particles are projected into the drum 25 from the outlet end 38, the lumps of molded sand are forced against the flights by the force of the abrasive shot. This force causes the large lumps to roll back over the short flights at the outlet end 38 and back into the drum 25. Thus, the larger lumps tend to remain in the barrel for a longer length of time which is necessary to effect a proper size reduction.

The drum 25 is provided with a plurality of apertures 39 to permit the passage of abrasive particles and granulated sand onto the oscillating conveyor 21 positioned below the drum 25. The abrasive particles and granulated sand pass through the upper surface 41 of the oscillating conveyor 21 and are conveyed along the bottom of the conveyor 21 to exit via passage 43. The core rods, trash and elements larger than the apertures 39 are driven by the spiral screw 37 out the outlet end 38 of the drum 25 and onto the upper surface 41. These larger elements remain on the screen deck or upper surface 41 of the oscillating conveyor 21 and are discharged therefrom.

Figure 5:
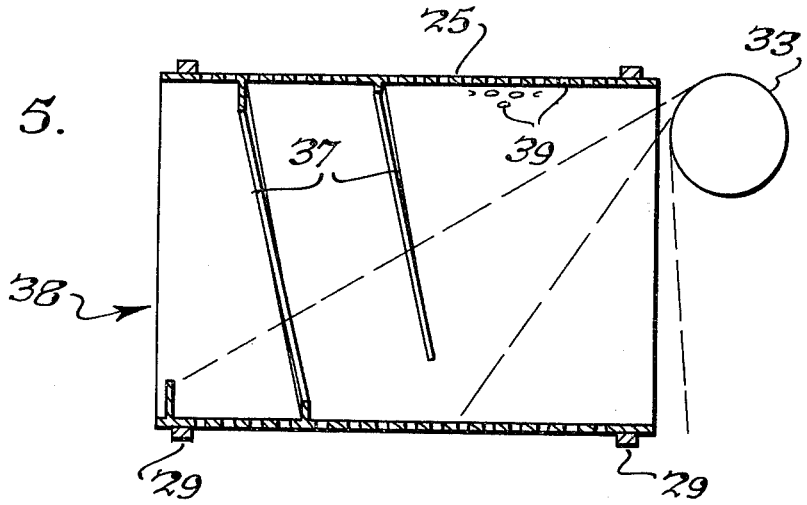
FIG. 5 is a side elevational view in section of one embodiment of the drum.
Figure 6:
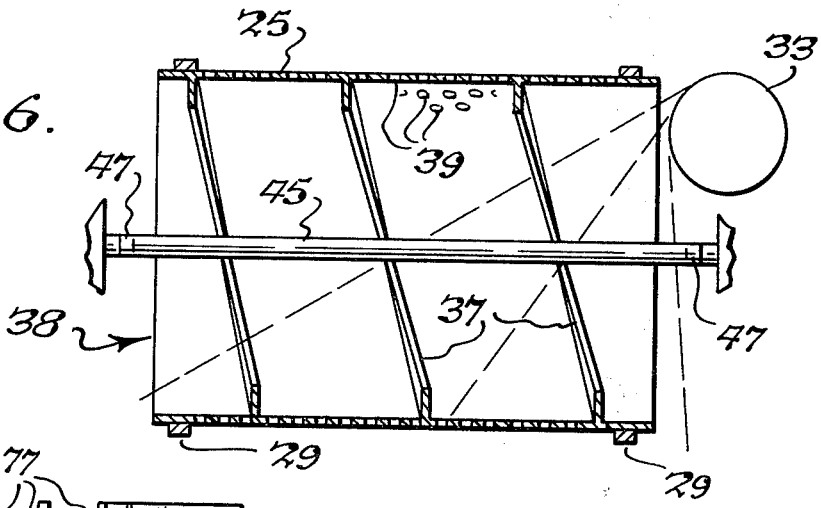
FIG. 6 is a side elevational view in section of another embodiment of the drum.
Figure 7:
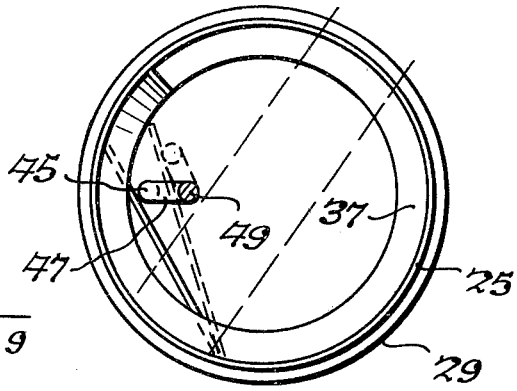
FIG. 7 is an end elevational view of the drum shown in FIG. 6.

FIGS. 5, 6 and 7 illustrate preferred embodiments of the drum 25 of the present invention. In FIG. 5, a preferred embodiment of the spiral screw 37 is illustrated. In this case, the spiral screw 37 terminates intermediate the ends of the drum 25, preferably about in the middle of the drum 25. This arrangement is preferable when the feed mixture comprises substantially lumps of molded sand. Due to the absence of flights at outlet end 38 of the drum 25, the force of the projected abrasive particles tends to keep the lumps within the drum 25 until they are completely granulated. If the feed mixture 11 contains core rods and other material which must be conveyed out the outlet end of the drum 25, it is preferable to have flights extending to the outlet end 38.

FIGS. 6 and 7 illustrate a preferred embodiment of the drum 25 of the present invention when the feed mixture 11 contains rods. In this case, the spiral screw 37 extends throughout the entire length of the drum 25. The rod 45 which is parallel to the axis of rotation of the drum 25 is spaced from the inside surface of the drum 25 so as to block the upward movement of core rods as the drum 25 rotates. Thus, core rods are prevented from tumbling and being blasted into the interior of the drum 25 by the force of projected abrasive particles. A spring loaded bracket 47 holds the rod in the proper position. Each bracket 47 is rigidly mounted at one end to the rod 45 and pivotably mounted at the other end for movement about a fixed axis 49. This pivotable mounting prevents core rods from becoming wedged between the rod 45 and the interior surface of the drum 25.

The abrasive blast means 33 includes a motor with a throwing wheel 51 mounted directly on the motor shaft. The throwing wheel 51 includes a runnerhead having a plurality of throwing vanes radially mounted thereon. The throwing wheel 51 is positioned at the outlet end 38 of the drum 25 and exterior thereto. The throwing wheel 51 is disposed at an angle to the axis of rotation of the drum 25 so that the abrasive particles or shot strike the tumbled pile of molded sand lumps from the lower end of the pile to the higher end thereof. The shot which is preferably large size metal shot is continuously projected into the mixture within the drum 25. The blasting stream is propelled lengthwise of the drum 25 for substantially the full length and contacts with blasting velocity the lumps of sand therein. The arrangement is such that the effect of the blast stream is to drive the lumps of molded sand against the direction of flow imparted by the spiral screw 37. The spiral screw 37 acts as a stop to prevent the backward flow and holds the lumps of molded sand against the force of the stream of shot until the lumps are effectively granulated. The drum 25 is mounted within an enclosed cabinet 53. A plurality of flexible vertically extending skirts 55 hang from the cabinet 53 to prevent the loss of ricocheting shot.

Figure 1:
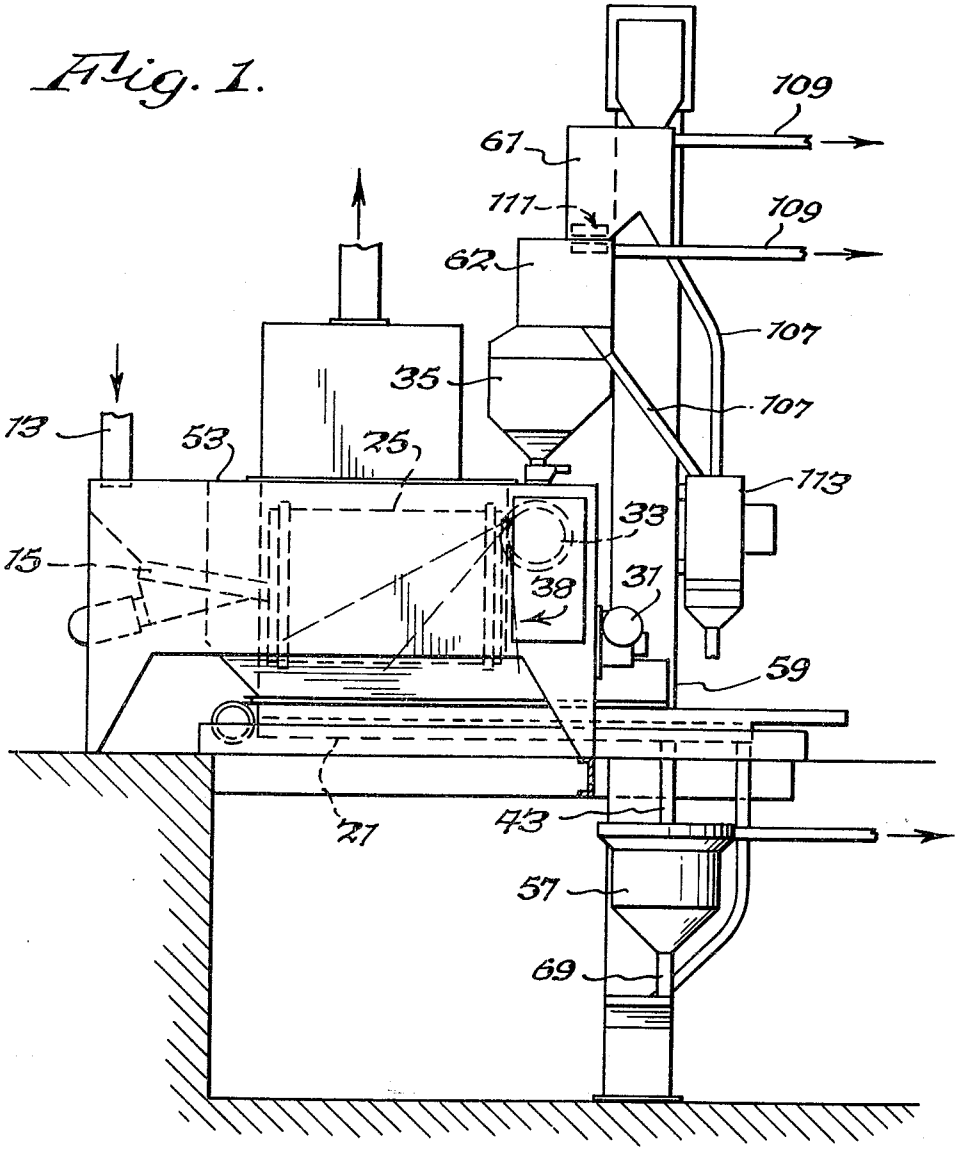
FIG. 1 is a side elevational view schematically showing one embodiment of the present invention.

The sand and shot mixture passes through passage 43 into a conditioner 57. The conditioner 57 subjects the sand in the mixture to a scouring treatment thereby removing accumulated coatings. After scouring, the sand is conveyed by an elevator 59 into an air wash separator 61 which separates the sand from the shot. Although FIGS. 1 and 2 illustrate an embodiment where the mixture including sand and shot are passed through a conditioner 57 prior to separation, an arrangement wherein the sand and shot mixture is passed through the air wash separator 61 prior to passing through a conditioner is contemplated by the present invention. This latter case is preferable when it is desirable to condition the sand in the absence of shot.

The conditioner 57 includes an outer housing 63 which is cylindrically shaped with a conical bottom 65. The side walls of the housing are radially spaced from a central axis. The passage 43 can serve as an inlet conduit 67 for the input of material to be conditioned. The inlet conduit 67 is in the top portion of the housing 63. An outlet conduit 69 is connected to the conical bottom 65 for the output of conditioned sand. The inlet conduit 67 and the outlet conduit 69 are coaxial with the central axis of the housing 63. When in operation, the conditioner 57 is placed so that the central axis is vertically aligned so that the material to be treated falls through the inlet conduit 67 and exits via the outlet conduit 69.

A centrifugal throwing wheel 71 is disposed intermediate the inlet conduit 67 and the outlet conduit 69. The throwing wheel 71 has an axis of rotation axially aligned and is disposed in the path of feed material falling through the inlet conduit 67. The feed material passing through the conduit 67 is projected radially outwardly by the throwing wheel 71.

Figure 9:
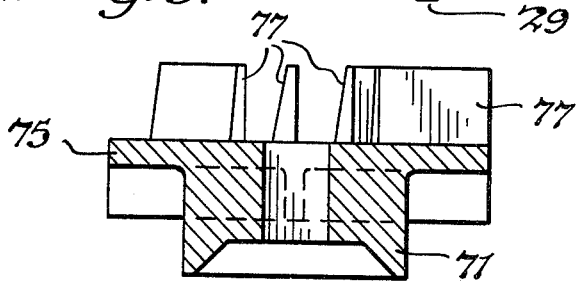
FIG. 9 is a side elevational view shown in section of the centrifugal throwing wheel of the conditioner.
Figure 10:
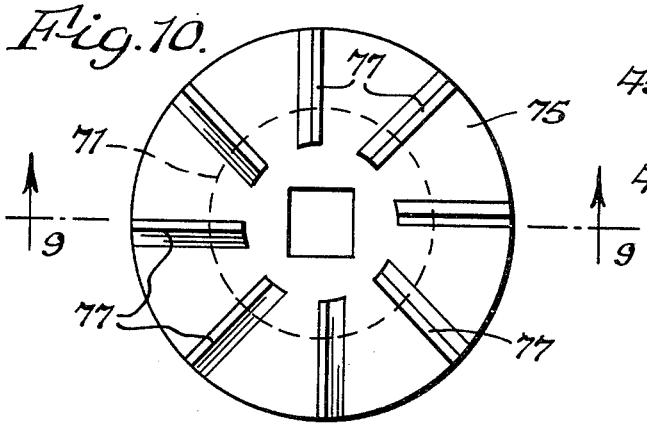
FIG. 10 is a top view of the centrifugal throwing wheel of FIG. 9.

The throwing wheel 71 includes a runnerhead 75 with a plurality of radially directed vanes 77. A distribution head 73 is cone shaped with the base of the cone contacting the central portion of the runnerhead 75 in the space in the center of the throwing wheel 71 between the vanes 77. Preferably the runnerhead 75 and the vanes 77 are of a one piece construction and are preferably made of polyurethane. This construction is illustrated in detail in FIGS. 9 and 10.

The runnerhead 75 is removably journaled on a spindle 79. The runnerhead 75 has a square axially aligned opening which matches a similarly shaped end of the spindle 79 so as to provide a positive drive engagement. The distribution cone 73 is secured by bolting it in place to the end of the spindle 79. This attachment also serves to keep the throwing wheel 71 in place.

The spindle 79 is axially aligned and mounted between spaced bearings for rotation. A pulley 81 at the lower end thereof is driven by an endless belt which is trained around another pulley 83 which is connected to the shaft of a motor 85. The motor 85 is mounted exterior to the housing 63 by a suitable bracket.

The feed material is projected radially outwardly from the axis of rotation of the throwing wheel 71 so as to give a 360° covarage of projected particles. An impact surface 87 is radially spaced from the axis of rotation of the throwing wheel 71. From a top view the impact surface is circular in shape so that the thrown particles travel a given distance before striking the impact surface 87.

Figure 8:
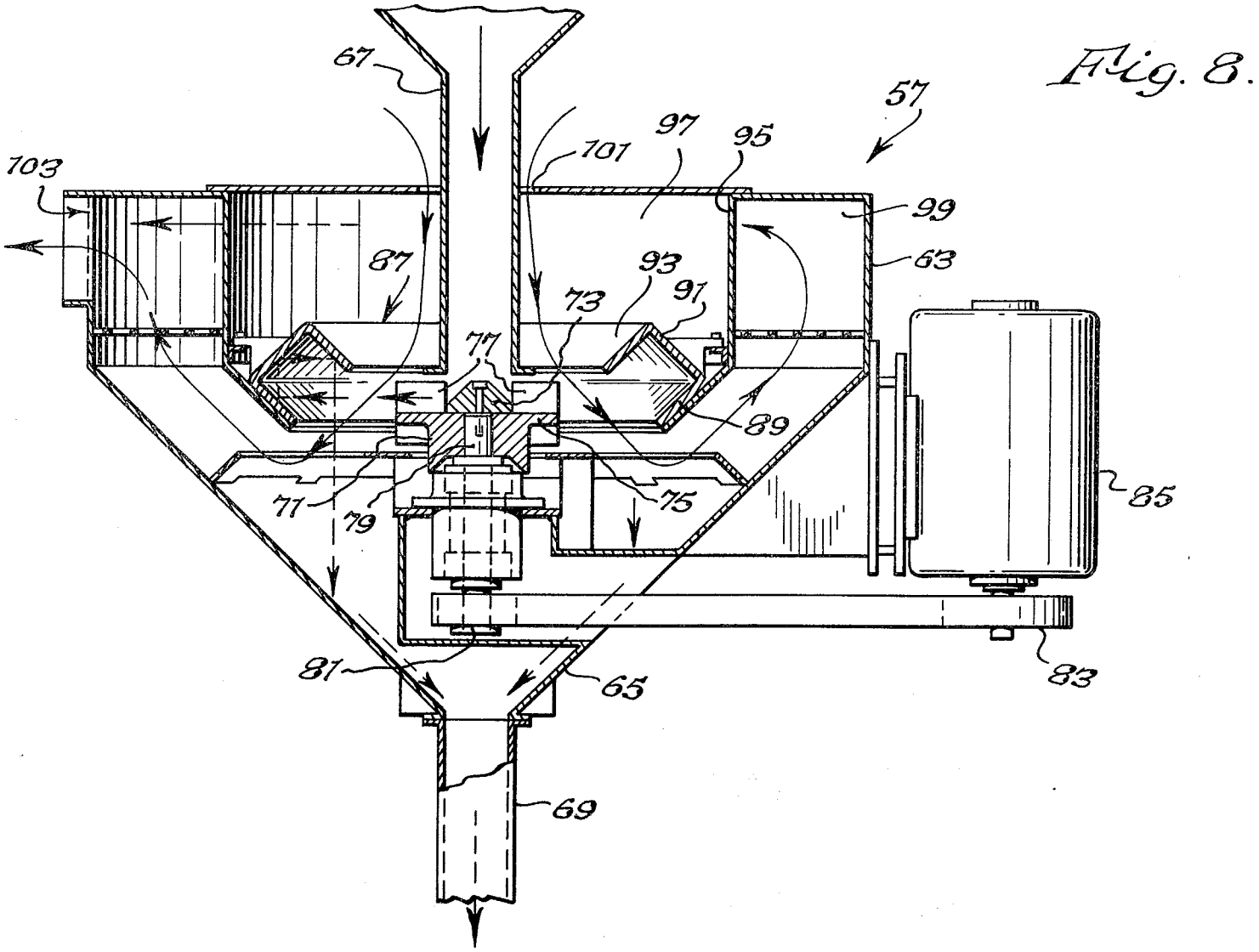
FIG. 8 is a side elevational view in section of the conditioner.

The impact surface 87 has a cross section which is shaped like a tilted U-shaped channel member. The impact surface 87 includes an impact plate 89 which is directly in the path of the projected particles and angularly disposed, preferably at about a 45° angle so as to direct the projected particles upwardly after rebounding. A ricochet plate 91 is connected to the impact plate at an angle, preferably at about a 90° angle thereto, so as to deflect rebounding particles from the impact plate 89 back toward the throwing wheel 71. A second ricochet plate 93 is connected to and at about a 90° angle to the first ricochet plate 91. The second ricochet plate 93 deflects particles downwardly toward the blast stream eminating from the centrifugal throwing wheel 71. This path is shown in FIG. 8 by a dotted line having arrows. The path is such that the collisions of the particles are maximized so that a scouring action is achieved. The particles fall into the conical bottom 65 where they exit via conduit 69.

The impact surface 87 is rigidly mounted in place to an inner wall 95. The inner wall 95 is concentric with the outer wall 63 so as to form an inner chamber 97 and an outer chamber 99.

According to the principles of the present invention, the particles projected from the throwing wheel 71 are immediately subjected to an air stream which flows through the projected and falling particles. The air stream flows through openings 101 in the top of the housing 63 and generally follows the solid lines with arrows as illustrated in FIG. 8. The air stream flows through the inner chamber 97 and downwardly through the projected particles and curves upwardly toward the outer chamber 99. The air stream is drawn through the outer chamber 99 by an outlet 103 or several outlets to evenly distribute the air flow which are connected to a low pressure source and a dust collector (not shown). The lighter particles such as dust or fines which are airborne are drawn through the outlet 103 and into the dust collector. The heavier particles continue to fall toward the bottom of the separator or to be projected against the impact surface 87. This arrangement results in a ricocheting particle being subjected to the air stream immediately after leaving the throwing wheel 71 prior to ricocheting and then again before falling into the conical bottom 65. Subjecting the particles to the air stream while in the free fall state effectively minimizes re-adherence of contaminants to the particles.

The conditioned sand passes through outlet conduit 69 into an elevator 59 which carries the mixture to a separator 61. Advantageously, at least a pair of separators 61 of the air wash type such as described and illustrated in U.S. Pat. No. 3,368,677 are utilized. In general, the air wash separator 61 subjects the falling mixture to a cross current of air. A number of skimmer plates are provided in a separating chamber to facilitate a separation of the mixture into individual streams in accordance with their weight. In this respect the abrasive particles are heavier than the sand which, in turn, is heavier than the fines and dust. Thus, the abrasive particles fall or drop generally directly downwardly into a discharge conduit 105 while the sand is diverted and received in another conduit 107. Fines, unusable sand grains and dust are conveyed through vents 109 to a dust collector (not shown).

It has been found that sand in the mixture fed to the separators is not always of the desired size of fines and frequently is in smaller lumps which may be termed pea size. Generally, such pea-size lumps are about 3/16 to ¼ of an inch in diameter. Since this pea-size sand is heavier than the fine grain sand, the pea size-sand will also go into the conduit with the abrasive particles which are large sized metal shot, thereby causing increased wear on the blast wheel vanes. Accordingly, it is necessary that this sand be separated from the abrasive particles if the sand recovery is to be maximized not for only reuse of the sand but for reuse of the abrasive particles. Therefore, it is preferable to include a second air wash separator 62 in the system. Prior to feeding the mixtures through the second air wash separator 62, the mixture of abrasive particles and pea-size sand is fed through a pair of rollers 111 which may be made of wear-resistant polyurethane. The closely positioned rotating rollers 11 crush the pea-size sand into fine granular form for permitting the abrasive particles to retain their normal size. This mixture of crushed sand and abrasive particles is then fed into the second separator 62. The second separator 62 collects the individual streams of sand and abrasive particles distinct from each other.

The substantially pure abrasive particles are received in hopper 35 for reuse by the abrasive blasting means 33. The sand passes through conduit 107 to a magnetic drum separator 113 which removes the small quantity of metal abrasive that may be mixed with the otherwise substantially pure sand. From the magnetic separator 113 the pure sand flows from an outlet 115 and can be conveyed to a hopper for storage or directly to a sand molding area for reuse.

Figure 11:
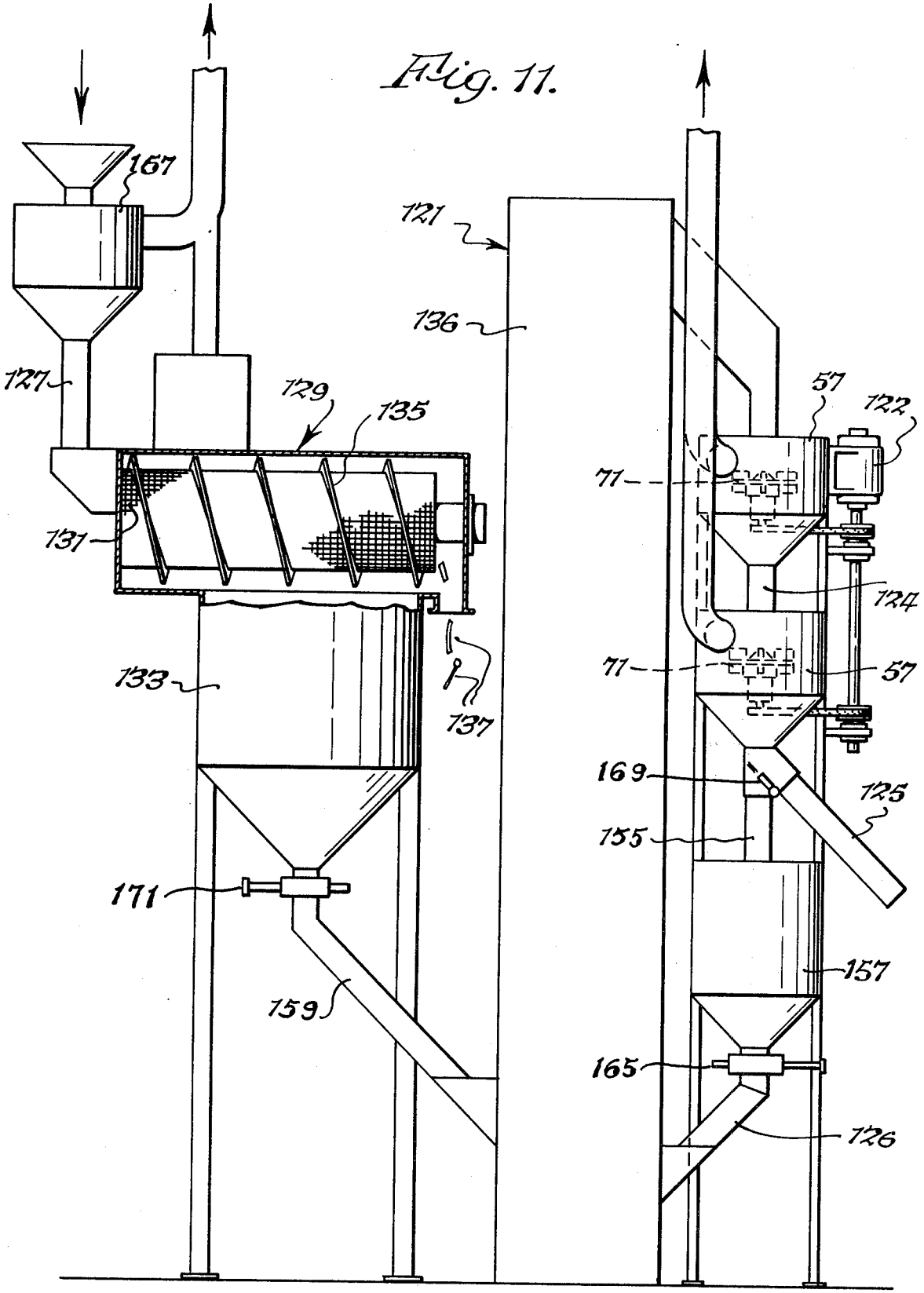
FIG. 11 is a side elevational view schematically showing a sand conditioning system of the present invention.
Figure 12:
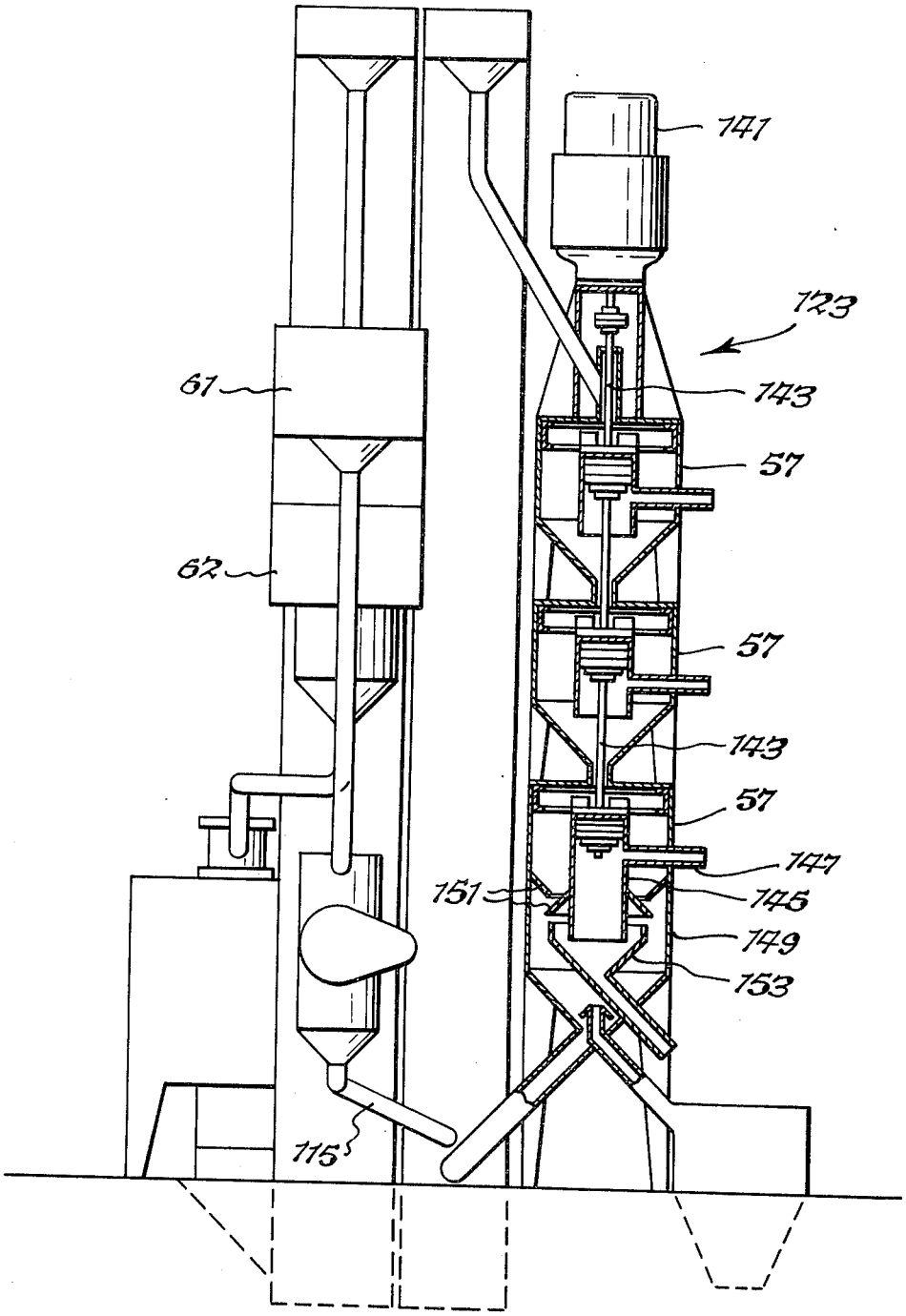
FIG. 12 shows an end elevational view of a sand reclamation system with a sand conditioning system connected thereto.

In the embodiment of the present invention as illustrated in FIG. 12, sand is conditioned after it passes through the air wash separators 61 and 62. In some cases, especially with green foundry sand, it is necessary to recycle the sand several times through a conditioner 57 to obtain the desired organic level or clay content. To achieve this end, the sand from the outlet 115 of the apparatus illustrated in FIG. 1 can be recycled through the conditioner 57. However, in many cases, the rate of sand flow will not allow this extra load on the conditioner 57 and separators 61 and 62. If considerable recycling is required, the sand may be fed into an auxiliary conditioning system generally indicated at 121 in FIG. 11 and at 123 in FIG. 12.

The acceptable limits for conditioning sand vary with each foundry and are related to the type of sand involved, kind of binder, whether green molding sand is involved and the use being made of the sand. Clay content of no-bake sand is generally not higher than approximately 2 percent. However, green molding sand may contain 9–10 percent clay and when this is mixed relatively few conditioning cycles are needed to reduce the level of clay to the 2 percent level, but to reduce the clay level to the 1 percent level, 15–20 reconditioning cycles may be required. Often several cycles are needed to reduce the organic residue remaining on the sand to the desired level.

In FIG. 11, the conditioning system 121 includes a plurality of stacked conditioners 57, each having mounted thereon a cenrifugal throwing wheel 71 for projecting sand in a horizontal direction against an impact surface 87. A single motor 122 mounted exterior to the conditioner drives a plurality of throwing wheels 71. The uppermost conditioner 57 has an outlet communicating with the inlet of the conditioner 57 immediately below through passage 124. As illustrated in FIG. 11, only two conditioners 57 are in stacked relationship, but it is contemplated by the present invention that any number of conditioners 57 can be stacked depending on the degree of conditioning desired. The conditioned sand may be diverted from the lowermost or bottommost conditioner 57 through an outlet passage 125 or can pass through conduit 155 into a storage area 157 by regulating a valve 169.

The sand reclamation system of FIG. 11 illustrates an embodiment of the present invention wherein it is not necessary to subject the lumps of molded sand to the action of projected abrasive particles. This embodiment is particularly useful if the sand is already in granulated form or if the lumps of sand are broken easily by merely passing the sand through a conditioner 167 of the type hereinbefore described. As illustrated in FIG. 11, the sand first passes through a conditioner 167 and passes into a separator 129 by a conduit 127. If the sand is mostly granulated, conditioner 167 is not needed and the sand can pass directly to separator 129.

The separator 129 includes a wire mesh scalping drum 131 which distributes the feed mixture along the entire width of the hopper 133. The scalping drum 131 includes a spiral screw 135 which projects interior to and exterior to the wire mesh. The spiral screw 135 aids in distributing granulated particles along the length of the hopper 133 while pushing the coarse scrap 137 out an open end of the drum 131.

The fine material which passes through the scalping drum 131 into the hopper 133 can be stored or conveyed into the conditioning system 121 by a conduit 159 which includes a valve 171. In operation, with valve 171 closed a charge of sand accumulates in hopper 131. Valve 171 is opened to convey the charge by a conduit 159 into the elevator 136 and thence through the conditioners 57. Valve 169 is adjusted so that the conditioned sand passes into conduit 155 and into storage hopper 157. With valve 165 of hopper 157 closed, the charge of sand accumulates in hopper 157. Preferably storage hopper 157 is at least the same capacity of storage hopper 133. When substantially the entire charge has been received in hopper 157 valve 165 is opened and the sand is recycled through the elevator 136 and conditioners 57 for a second pass. By regulating valve 165 the number of passes of sand through the conditioners 57 can be carefully controlled so that the optimum conditioning of the sand is obtained.

When the sand has been sufficiently conditioned, valve 169 can be adjusted to divert the final pass of sand through conduit 125 and to a storage area or work area. Thus, the conditioning system 121 is ready to receive a second charge of sand from hopper 133 which can be accumulated while the first charge is being conditioned. The second charge is processed in a manner similar to the first charge.

FIG. 12 illustrates an embodiment of the present invention wherein the conditioners are stacked and driven by a single motor 141. The throwing wheels 71 of each conditioner 57 is mounted on a single shaft 143 which is directly connected to the shaft of the motor 141.

The stacked conditioning system 123 of FIG. 12 includes a separating system. The lower conditioner 57 includes an inner housing 145 having a vent line 147 connected thereto. The inner housing 145 has a vertical wall substantially concentric with the wall of the outer housing 149. The inner housing 145 and the outer housing 149 are provided with baffles 151 to provide a slow and smooth falling stream of material. A conical conduit 153 is positioned below the inner housing 145 and includes a portion concentric with and spaced from the inner housing 145. As the sand falls over the flanged lip or lower baffle 151 of the inner housing 145, the fine particles of sand are drawn inwardly into the conical conduit 153 by the suction maintained through the vent line 147. The fine dust passes through the vent line while fines of a predetermined size are drawn into the conical conduit 153 and exit at an opening in the bottom thereof. Heavier particles fall downwardly to be recirculated or pass into a storage hopper.

It is contemplated that sand conditioners may be arranged in a variety of ways to accommodate large quantities of sand. A plurality of stacked conditioners can communicate with a single elevator for processing sand or a plurality of stacked conditioning units can be arranged in series with various recycling means provided to provide fast, efficient and complete sand conditioning.

Preferred embodiments of this invention having been described and illustrated, it is to be realized that modifications thereof may be made without departing from the broad spirit and scope of the present invention as described in the appended claims.

What is claimed is:

1. Apparatus for use in connection with blast equipment, said apparatus comprising:

a. a drum including an inlet end, an outlet end, a hollow interior and an inner surface;

b. a plurality of apertures formed in said drum for providing passage ways for granulated material and blast particles therethrough;

c. spiral screw means disposed within said drum and operatively associated with said inner surfaces;

d. said spiral screw means including a first section near said inlet end and a second section near said outlet end, each section extending generally radially inwardly of said drum from said inner surface;

e. said first section extending a greater distance radially inwardly of said drum than second section, and f. said spiral screw means having a taper from said inlet end to said outlet end of said drum, said spiral screw means being larger at said inlet end than at said outlet end.

* * * * *